US009386855B2

(12) United States Patent
Sabounjian

(10) Patent No.: US 9,386,855 B2
(45) Date of Patent: Jul. 12, 2016

(54) STORAGE RACK AND CROSS-BAR SUPPORT

(71) Applicant: Pro-Mart Industries, Inc., Irvine, CA (US)

(72) Inventor: Azad Sabounjian, Irvine, CA (US)

(73) Assignee: Pro-Mart Industries, Inc., Irvine, CA (US)

( * ) Notice: Subject to any disclaimer, the term of this patent is extended or adjusted under 35 U.S.C. 154(b) by 24 days.

(21) Appl. No.: 14/494,458

(22) Filed: Sep. 23, 2014

(65) Prior Publication Data

US 2015/0090683 A1 Apr. 2, 2015

Related U.S. Application Data

(60) Provisional application No. 61/883,752, filed on Sep. 27, 2013.

(51) Int. Cl.

| | |
|---|---|
| ***A47B 96/14*** | (2006.01) |
| ***A47B 47/02*** | (2006.01) |
| *A47B 47/00* | (2006.01) |

(52) U.S. Cl.

CPC ..... *A47B 96/14* (2013.01); *A47B 47/028* (2013.01); *A47B 47/0083* (2013.01)

(58) Field of Classification Search

CPC .. A47B 96/14; A47B 96/1441; A47B 47/028; A47B 47/0083

USPC ..... 211/186, 187, 190, 191, 192

See application file for complete search history.

(56) References Cited

U.S. PATENT DOCUMENTS

| | | | | | |
|---|---|---|---|---|---|
| RE24,535 | E | | 9/1958 | Franks | |
| 3,018,862 | A | * | 1/1962 | Litteral | A47B 47/021 211/186 |
| 3,266,635 | A | * | 8/1966 | McConnell | A47B 57/402 211/187 |
| 3,351,212 | A | * | 11/1967 | McConnell | A47B 57/402 211/187 |
| 3,463,325 | A | * | 8/1969 | Rogers | A47B 57/00 211/187 |
| 3,601,432 | A | | 8/1971 | Fenwick | |
| 3,846,944 | A | * | 11/1974 | Lambert | F16B 12/34 211/187 |
| 3,989,399 | A | * | 11/1976 | Slowbe | E04B 9/127 403/230 |
| 4,074,812 | A | | 2/1978 | Skubic et al. | |
| 4,467,729 | A | * | 8/1984 | Featherman | A47B 57/16 108/107 |

(Continued)

FOREIGN PATENT DOCUMENTS

| | | |
|---|---|---|
| EP | 0579364 B1 | 12/1997 |
| GB | 2486640 A | 6/2012 |

*Primary Examiner* — Stanton L Krycinski

(74) *Attorney, Agent, or Firm* — Stetina Brunda Garred & Brucker; Lowell Anderson

(57) ABSTRACT

A cross-bar is provided for a shelving assembly having vertical corner posts joined by horizontal deck beams with the cross-bar extending between deck beams to support the shelving material supported by the beams. The cross-bar has an offset connecting bracket at each end. The offset allows the bracket to fit underneath a deck beam flange so the bracket can engage protruding rivets on the inside of open-section deck beams.

19 Claims, 8 Drawing Sheets

(56) References Cited

U.S. PATENT DOCUMENTS

| | | | | |
|---|---|---|---|---|
| 5,011,031 | A | 4/1991 | Konstant | |
| 5,279,431 | A | 1/1994 | Highsmith et al. | |
| 5,624,045 | A | 4/1997 | Highsmith et al. | |
| 5,628,415 | A * | 5/1997 | Mulholland | A47B 47/027 211/186 |
| 6,425,558 | B1 * | 7/2002 | Saunders | B65D 88/129 108/143 |
| 6,425,563 | B1 * | 7/2002 | Mihailoff | A47B 57/54 211/192 |
| 7,810,770 | B2 * | 10/2010 | Treadwell | A47B 47/027 248/200 |
| 7,975,448 | B2 * | 7/2011 | Jahn | E04B 9/068 52/220.6 |
| 8,443,992 | B2 * | 5/2013 | Lawson | A47B 47/024 211/187 |
| 9,027,767 | B2 * | 5/2015 | Buckley | A47F 5/00 211/134 |
| 2009/0007520 | A1 | 1/2009 | Navon | |
| 2012/0000871 | A1 * | 1/2012 | Troyner | A47B 47/021 211/134 |
| 2012/0067838 | A1 | 3/2012 | Lawson et al. | |

* cited by examiner

STORAGE RACK AND CROSS-BAR SUPPORT

CROSS-REFERENCE TO RELATED APPLICATIONS

The application claims the benefit under 35 U.S.C. §119(e) to Provisional Patent Application No. 61/883,752 filed Sep. 27, 2013, the entire contents of which are incorporated herein by reference.

BACKGROUND

The present invention relates generally to shelf-type storage rack systems, particularly an improved cross-bar that extends between the front and back beams supporting shelves and that is readily removable and reusable.

Shelf-type storage racks typically include at least four vertical posts or columns at each corner of a rectangle. The posts are interconnected by generally horizontal deck beams which extend horizontally between two adjacent front posts and between two adjacent back posts. Shelves are supported on the horizontal deck beams. If the load carried by the shelves is heavy then cross-bar supports are added that extend between the front and back beams, generally in the same plane.

One way of creating the storage shelves is the use of wooden slats that extend between the deck beams. In order to keep the slats from being moved along the axis of the slat the front and back deck beams are typically roll formed to provide a ridge or lip or notch on their upper surface of opposing deck beams upon which the wooden slats are placed. The specially formed beams must be configured to accommodate the specific thickness of the slats or else the surface formed by the slats is offset from the surface of the deck beams and boxes of items placed on the slats may be above or below the deck beam. If the surface on which the boxes rest is below the deck beam then the beam impedes removal of the box. Further, the slats may be knocked-out, skewed or otherwise misaligned between the deck beams, causing the slats to fall and the shelf to be weakened. It also requires specially shaped deck beams. Thus, there are disadvantages such as increased construction costs and decreased flexibility.

If the deck beams and shelves are heavily loaded the deck beams sag toward the center and there is some tendency for the cross-bars supporting the shelving rack to bow in such a way that they either move apart or possibly disengage from the deck beams. Moreover, problems may arise because of irregularities in the floor on which the storage rack is placed, which irregularities cause the posts to lean further apart than intended and that in turn can cause unexpected spacing problems between columns and between deck beams. These spacing errors, along with errors in the length and width of the beams and columns can result in the creation of variable distances between deck beams that can cause difficulties in assembling and fastening the parts together to form the storage racks, especially in fastening cross-bars to opposing, front and back deck beams. There is thus a need for an improved system for attaching cross-bars to opposing deck beams to create the framing for storage shelves. The is also a need for an improved cross-bar that is readily removable and reusable yet can be locked or secured against undesired movement and rolling to create a shelf that properly supports loads.

BRIEF SUMMARY

A cross-bar is provided for a shelving assembly having vertical corner posts joined by horizontal deck beams. The cross-bar extends between two parallel deck beams to support the shelving material that is supported by the beams. The cross-bar has an offset connecting bracket at each end. The offset allows the connecting bracket to fit underneath an inward-extending flange on the deck beam flange so the bracket can engage protruding rivets on the inside of open-section deck beams with a top flange of the cross-beam flush with the deck beam flange. The shelving material rests on the deck beam flange and the cross-beam flange.

There is thus provided an improved cross-bar is provided a support frame for a shelf assembly. The shelf assembly typically includes a pair of rear posts extending upward and an opposed pair front posts extending upward. The posts are usually at corners of a rectangle. Elongated front and rear deck beams extend between and are to respective pairs of rear posts and front posts in the same plane and parallel to each other to define a support for a shelf. Each of the deck beams has an open cross-section with a vertical beam web and opposing top and bottom flanges extending toward an inside of the shelf assembly. The opposing top and bottom flanges are separated by a distance D. The top flange has a width W and is offset vertically by a distance O below a top edge of the vertical beam web. The beam web has at least one pair of vertically aligned connectors extending inward from the beam web. Each connector has an enlarged connector head with a short connector shaft extending between the head and shaft.

The cross-bar extends between the front and rear deck beams. The cross-bar is an elongated member having a vertical cross-bar web with at least a top flange and preferably opposing top and bottom flanges extending laterally to a first side of the cross-bar web and at right angles to the cross-bar web. The cross-bar web has a height H which is less than the distance D. The vertical cross-bar web has a reduced height web section with a height R at opposing ends of the elongated member and the top flange do not extend along the educed height web section. Each reduced height web section ends in a connecting bracket that extends laterally to the first side of the cross-bar and at right angles to the reduced height web section. Each connecting bracket has at least two hooks extending laterally in the plane of the connecting bracket with each hook defining a vertical recess and with at least one hook defining a lateral opening thereto. The recess are configured to receive the short connector shaft but not allow passage of the enlarged connector head. Each hook is sized to fit between the beam web and the enlarged head of the connector during use.

The height R of the reduced height web section is smaller than the distance D and height H so that the reduced height web section may fit vertically between the opposing top and bottom flanges of the deck beam and allow the connector shafts to enter the lateral openings of the at least one hook and move downward so the connector shafts engage the connector recesses during use. Further, the reduced height web section extends from the connecting bracket a distance sufficient so the top flange of the cross-bar is adjacent to the top flange of the deck-beam and the height H of the cross-bar is selected so the top flange of the cross-bar is flush with the top flange of the deck beam.

In further variations, the lateral entrance to the recess is configured to allow passage of the connector shaft but not the enlarged connector head. Each hook may be configured to fit snugly between the connector head and the vertical deck beam web. The height R of the reduced height web section and the height of the cross-bar web H section may differ by about twice the offset distance O. The reduced height web section preferably has a length that is about twice the width W.

The cross-bar may have a bottom flange extending along a length of the cross-bar vertical web.

When the cross-bar and its variations are be combined with the support frame they may form a shelf assembly. Likewise, if unassembled but provided with the various parts of the support frame and shelf assembly, they may form a kit for a shelf assembly.

BRIEF DESCRIPTION OF THE DRAWINGS

These and other features and advantages of the invention will become more apparent in light of the following discussion and drawings, in which like numbers refer to like parts throughout, and in which.

DETAILED DESCRIPTION

Figure 1:
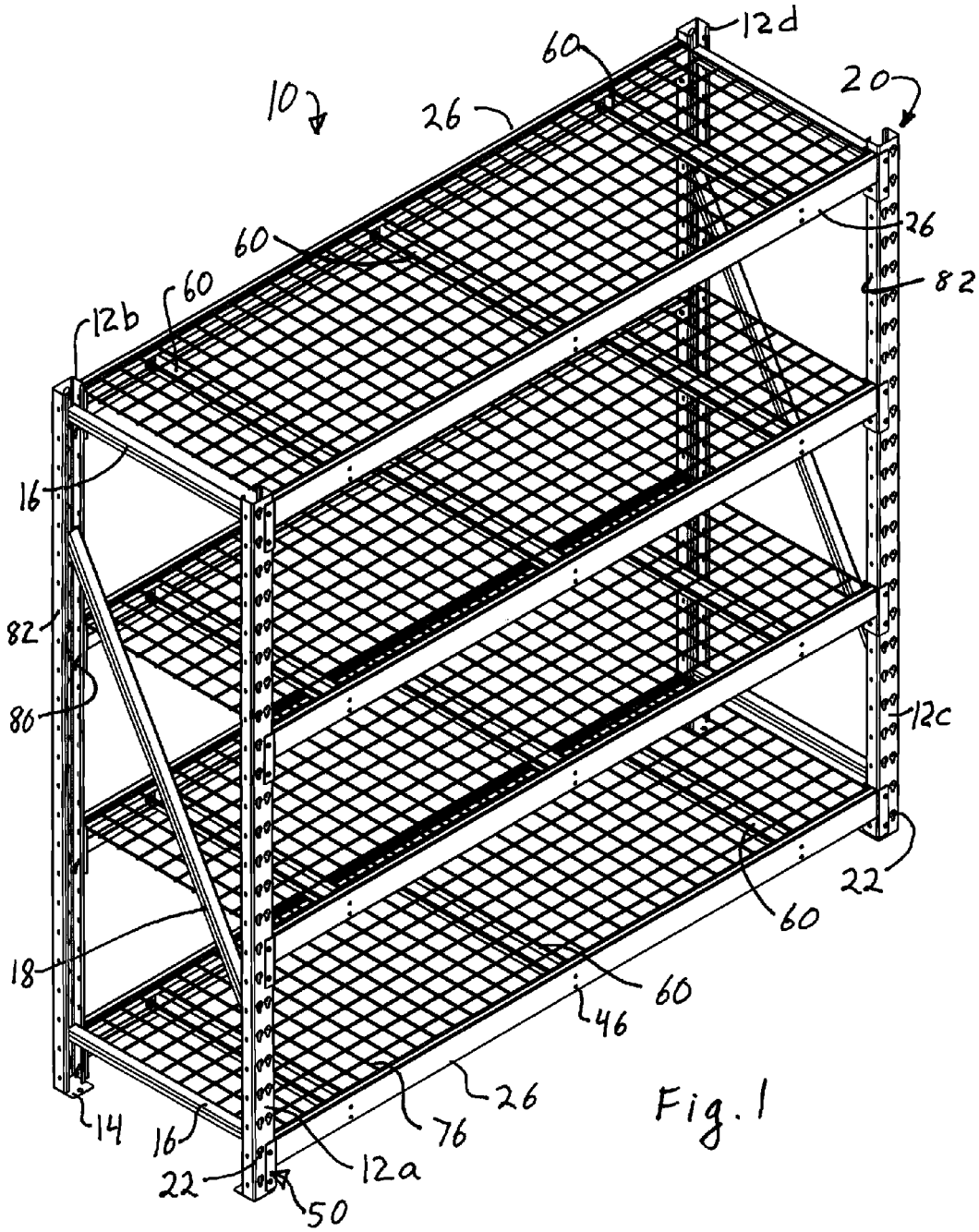
FIG. 1 is a downward perspective view of a storage rack and shelf system using the cross-bar of the present invention.
Figure 2:
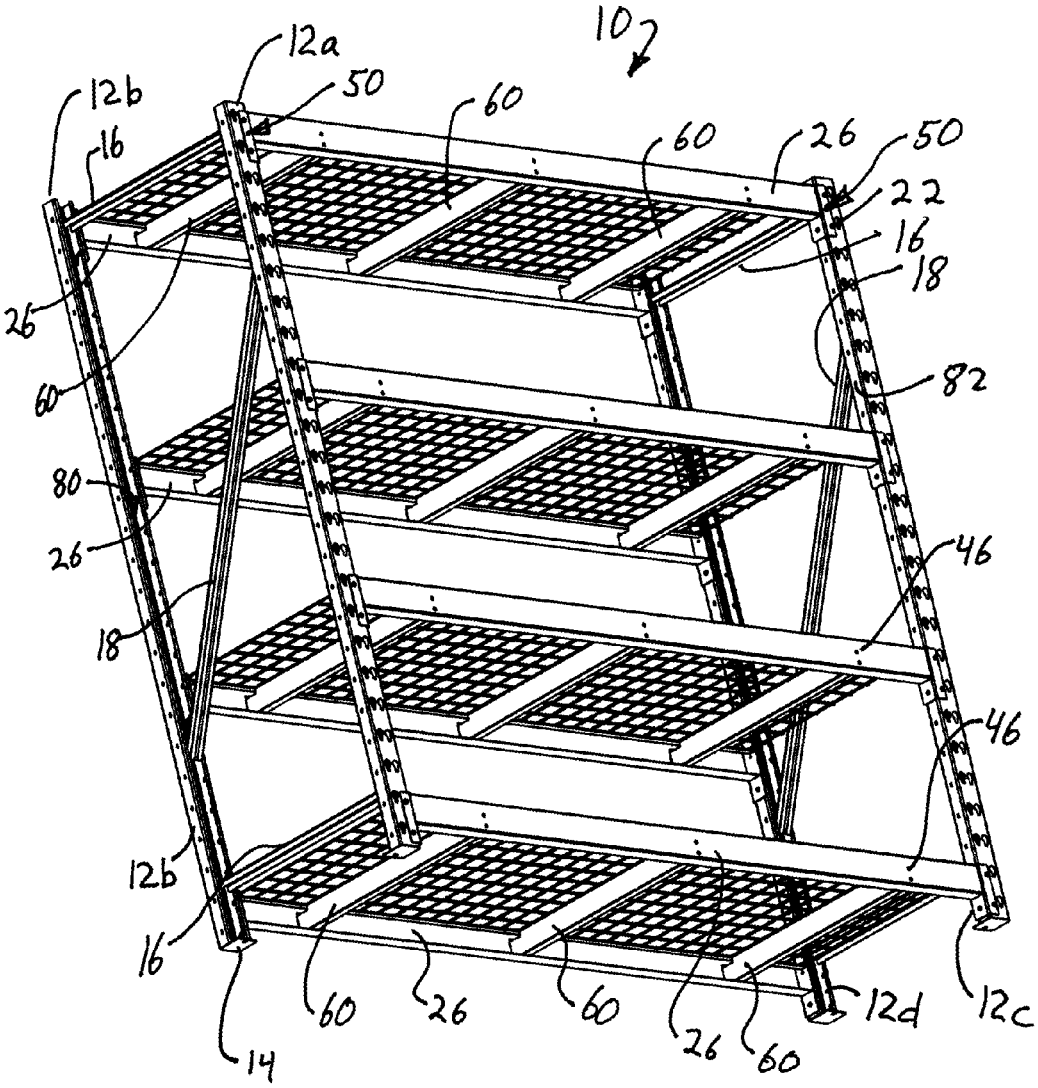
FIG. 2 is an upward perspective view of the storage rack and shelf system of FIG. 1.
Figure 3:
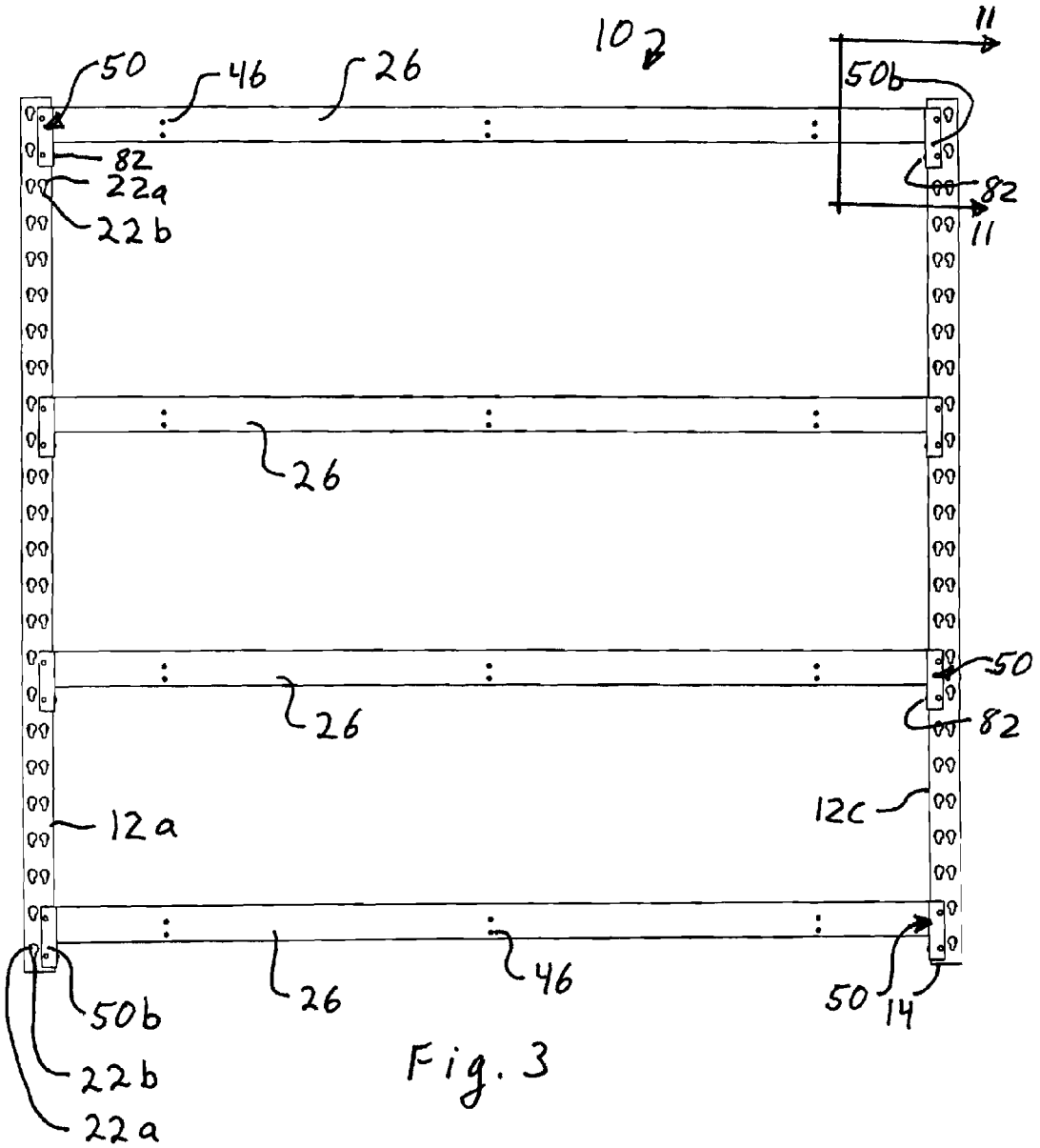
FIG. 3 is a front elevation view of the storage rack and shelf system of FIG. 1 with the back view being a mirror image thereof.
Figure 4:
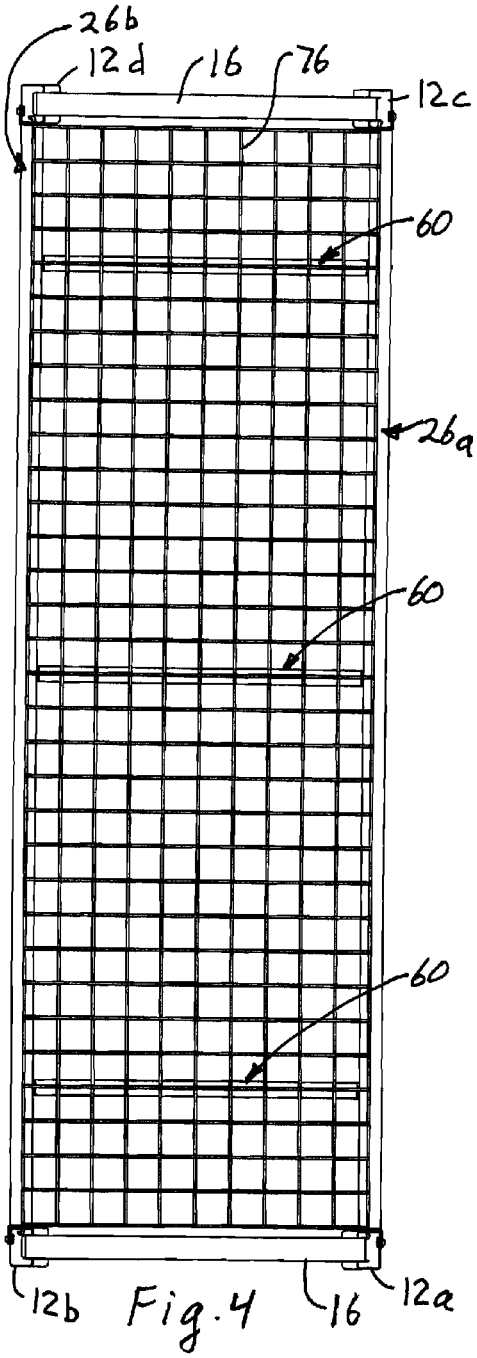
FIG. 4 is a top elevation view of the storage rack and shelf system of FIG. 1.
Figure 5:
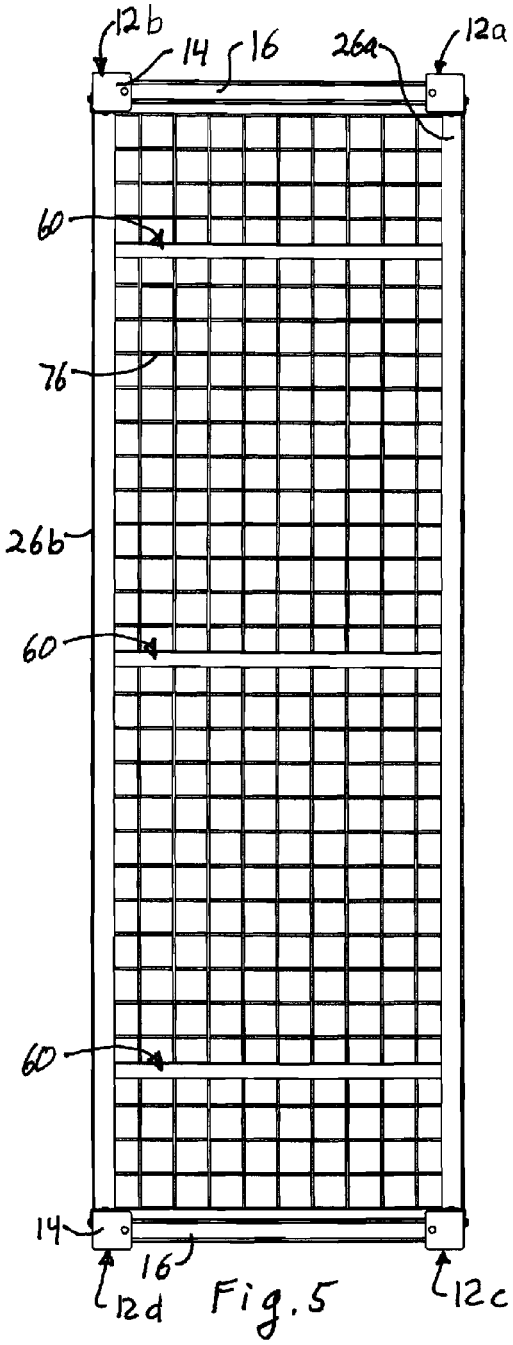
FIG. 5 is a bottom elevation view of the storage rack and shelf system of FIG. 1.
Figure 7:
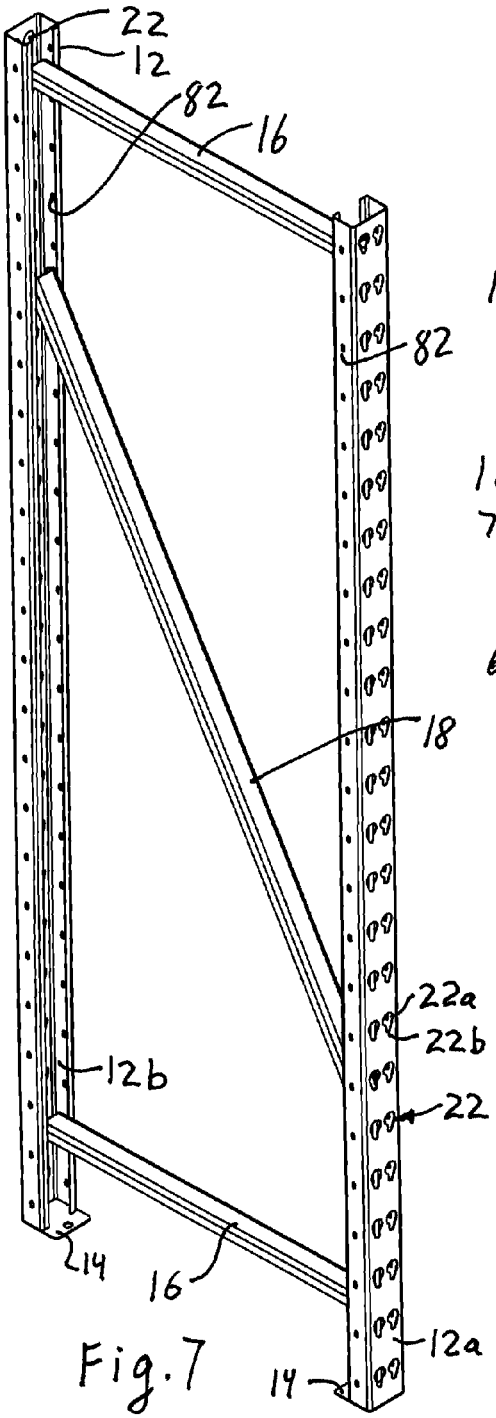
FIG. 7 is a perspective view of the end frame assembly of the storage rack of FIG. 6.
Figure 6:
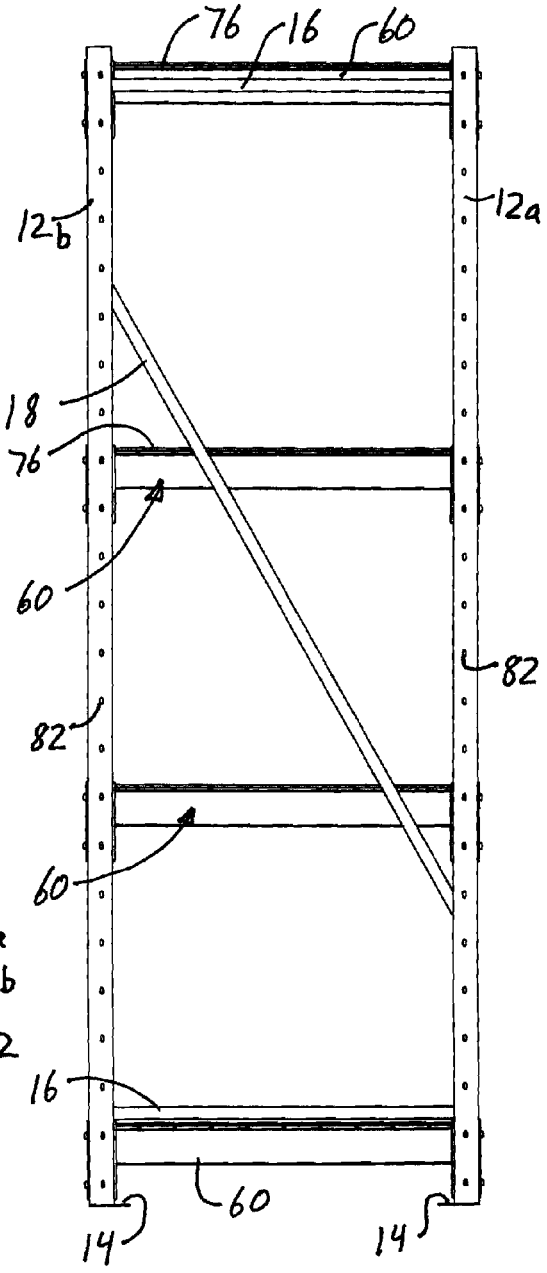
FIG. 6 is a left side elevation view of the storage rack and shelf system of FIG. 1 with the opposing side being a minor image thereof.
Figure 8:
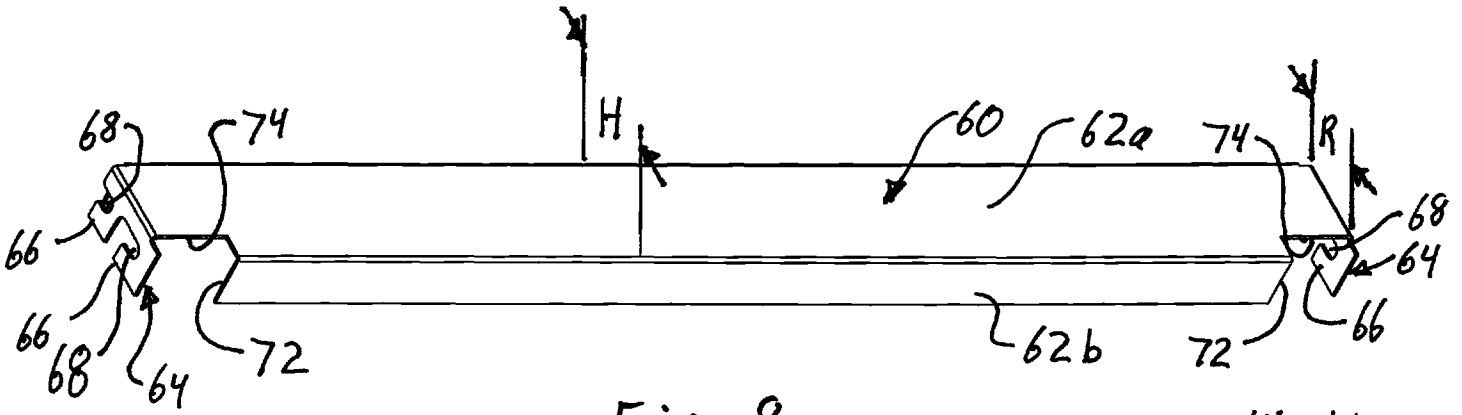
FIG. 8 is a perspective view of a cross-bar as used in FIG. 1.

Referring to FIGS. 1-7, a storage rack 10 includes at least vertical supports or posts 12 which are typically vertical or substantially vertical, with a bottom of each post having a base 14 configured to rest against a support surface, such as a floor. The base 14 typically has a flat surface abutting the support surface. The posts 12 are generally arranged at the corners of a rectangle with a front and rear post at each end of the rectangle. The posts 12 may be referred to herein as corner posts. As used herein the relative directions front and rear are with respect to an aisle along which the storage rack 10 is placed with two, spaced apart front posts adjacent the aisle and two rear posts further away from the aisle. The relative directions of inward and outward refer to the relative direction toward an inside of the storage rack 10. The relative directions up and down, upwards or downwards, or above and below, are with respect to the direction of gravity when the storage rack 10 is in its vertical, use position.

Each of the pair of front posts 12*a*, 12*c* and rear posts 12*b* and 12*d* are preferably, but optionally, rigidly interconnected to one another by a plurality of end frame members 16 and at least one diagonal brace 18. The end frame members 16 are located at or adjacent to the top and bottom of the posts 12*a*, 12*b* and the posts 12*c* and 12*d*, and preferably offset from the ends so that posts 12 can be bolted end-to-end to increase the length of the post. The depicted end frame members 16 are horizontal. The depicted posts 12 are channel members having a C-shaped cross section while the end frame members 16 and diagonal brace have an L-shaped cross section. The cross-sectional shape of the posts 12, frame members 16 and braces 18 will vary with the design strength of the storage rack 10, as will the thickness or gauge of the material used. The posts 12, frame members 16 and diagonal brace 18 may be bolted together or fastened by any known means. But those parts are preferably of metal and are welded together to form an end frame assembly 20. There is a left and right frame assembly shown in FIG. 1. The number, location and shape of frame members 16 and braces 18 may vary.

The posts 12 have a plurality of aligned beam openings 22. The beam openings 22 may be on various sides of the posts and may have various shapes. The depicted beam openings 22 are on the front side of the front posts 12*a*, 12*c* and on the back side of the posts 12*b*, 12*d*. The beam openings 22 preferably have a tear drop shape known in the art with a generally circular top portion 22*a* (FIGS. 3 and 7) and a narrower bottom portion so that an enlarged head of a connector can fit in the larger top portion 22*a* and be restrained by the smaller bottom portion which receives the smaller sized shaft to which the enlarged connector head is fastened. Exemplary openings 22 are described in U.S. Pat. Nos. 4,074,812 and 5,624,045, the complete contents of which are incorporated herein by reference. The beam openings are preferably formed in pairs so two openings 22 are adjacent each other. The beam openings 22 are configured to receive connectors on deck beams as described later. The posts 12 also preferably have a plurality of spaced shelf openings 24 in both sides of the posts 12, at the same general locations as the beam openings 22.

Extending horizontally between the adjacent posts 12 are horizontal deck beams 26, with front deck beams 26*a* extending between adjacent front posts 12*a*, 12*c* and rear deck beams 26*b* extending between adjacent rear posts 12*b*, 12*d*. The front and rear deck beams 26*a*, 26*b* extend between and are supported by each of the front (12*a*, 12*c*) and rear posts 12*c*, 12*d*, respectively. A plurality of deck beams extend between the posts 12 at the location of each desired shelf. Four rows of deck beams are shown in FIG. 1.

The deck beams 26 have a shaped cross-section which forms a horizontal ledge or shoulder 28 inward of a face of the beam 26 and below an upper edge or side of the deck beam. Such a shoulder 28 is described in a cross beam having an open section in previously mentioned U.S. Pat. No. 4,074,812.

Figure 9:
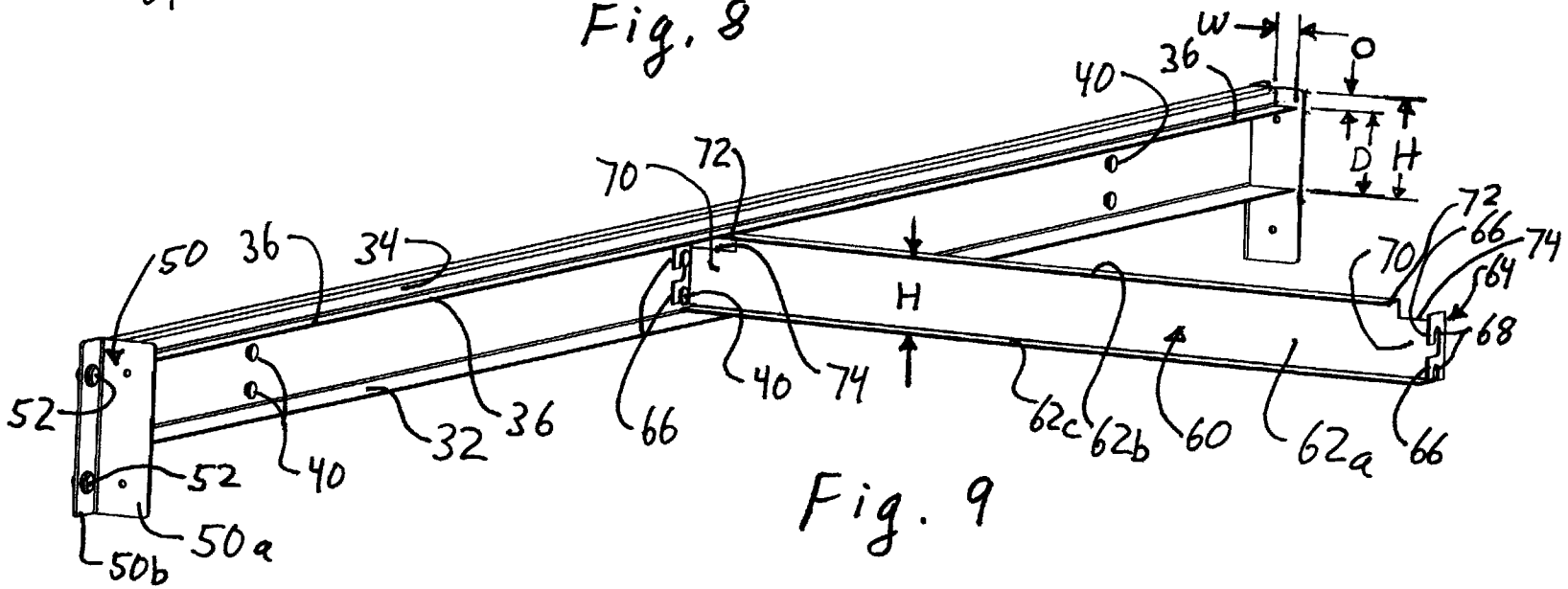
FIG. 9 is a perspective view of the cross-bar of FIG. 1 connected to a deck beam.
Figure 11:
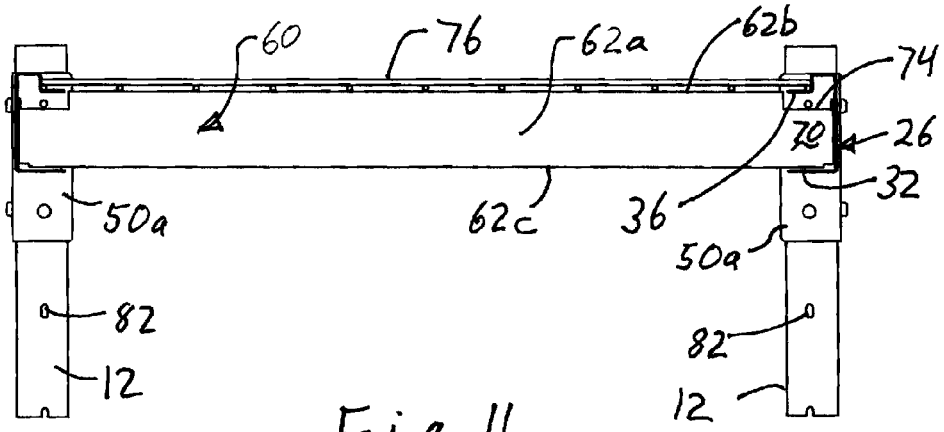
FIG. 11 is sectional view taken along section 11-11 of FIG. 3.
Figure 10:
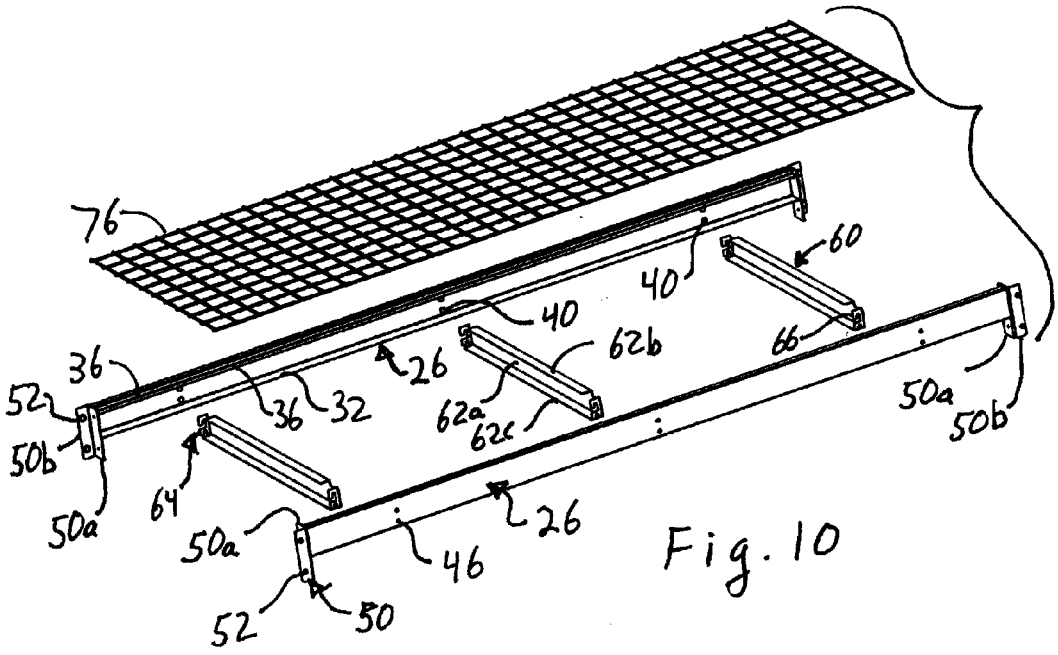
FIG. 10 is an exploded perspective view of a shelf assembly, including the cross-bar of FIG. 9 between two deck beams and below a shelf.
Figure 12:
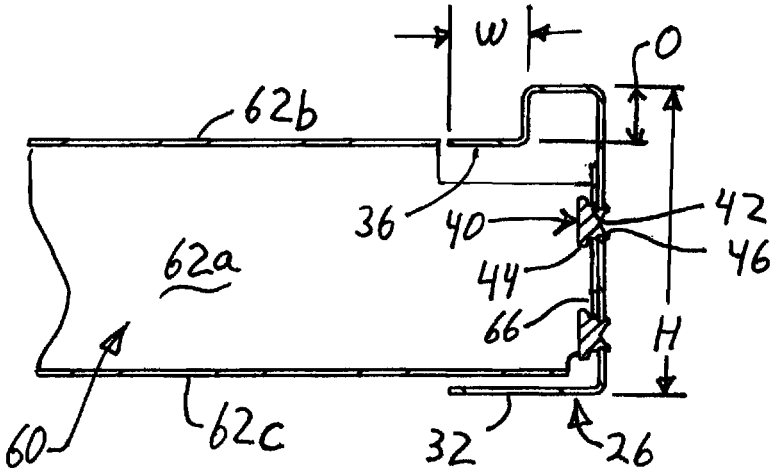
FIG. 12 is an enlarged sectional view of a portion of a deck beam, connectors and cross-bar.

Referring to FIGS. 9-11, the preferred deck beams 26 have an open cross-section with a front plate 30 that is vertical during use, a bottom flange 32 extending inward from a bottom end of the front plate 30 and preferably extending horizontal and perpendicular relative to front plate 30. The beams 26 preferably have a rolled top portion 34 that rolls back parallel to but offset from front plate 30, with an inwardly extending top flange or shoulder 36 located at the end of the rolled top portion 34. The rolled top portion 34 may roll back immediately adjacent to and abutting the front plate 30, or it may extend perpendicular to the front plate 30 a distance before extending downward as shown in FIGS. 9-12. As seen in FIGS. 9, 11 and 12, the rolled top portion 34 may extend a distance that is about the same as the width W of the shoulder or top flange 36. The shoulder or top flange 36 is preferably horizontal and preferably perpendicular to plate 30 and rolled top portion 34, and is offset downward from and below the top edge of front plate 30.

Referring further to FIGS. 9-12, the deck beams 26 have rivet or connectors 40 extending inward from plate 30. The connectors 40 have a shaft, preferably cylindrical ending in an enlarged distal end 42 (FIG. 12) that is preferably circular like a nail head or rivet head that has a larger diameter than the shaft. The connector 40 is advantageously made of high strength steel, preferably of stainless steel, and may have a fastening end 46 that is formed when the shaft 42 is placed through a hole at the location of the connector 40 with the end upset or deformed to form fastening end 46 to fasten the rivet-like connector 40 to the face 30 of beam 26. Advantageously there are two vertically aligned connectors 40 at various locations along the length of deck beam 26 as described later, forming vertically aligned pairs of connectors 40. The connectors 40 may also be made of flat strips of steel having a rectangular cross-section and forming projecting fingers as in the patents incorporated by reference.

The ends of the deck beams 26 have mounting brackets 50 which are configured to releasably engage the posts 12 and openings 22. The depicted mounting brackets 50 are angle iron having an L-shaped cross-sectional shape with two legs 50*a*, 50*b* at right angles to each other. First leg 50*a* extends vertically and is welded or otherwise fastened to the end of deck beam 26 and preferably welded to flanges 32, 36 as well as plate 30 and rolled top portion 34. The second leg 50*b* has two connectors 52, also referred to as second connectors 52 configured to releasably engage openings 22. The connectors 52 are preferably like the connectors 40 and are thus not described in detail. The enlarged head of connectors 52 fit in the larger, top openings 22*a* (FIG. 1) and slide down so the smaller bottom opening 22*b* (FIG. 1) restrains removal of the connector. The mounting brackets 50 are configured so the bracket legs 50*b* abut the front face of front posts 12*a*, 12*c* and abut the rear face of posts 12*b*, 12*d*. The brackets 50 could be configured to abut the sides the posts facing each other. The specific configuration of the brackets 50 is thus not believed critical as long as the brackets allow connectors 52 to releasably connect to openings 22 it he posts 12.

By engaging different sets of openings 22, the deck beams 26 may be positioned at various heights. The openings 22 in the posts 12 are located sot the connectors 52 and openings 22 allow the front and rear deck beams 26*a*, 26*b* to be placed are in a horizontal plane, for each pair of front and rear deck beams engaging the posts 12.

Referring to FIGS. 1-2 and 9-12, a cross-bar 60 extends between the front and rear deck beams 26*a*, 26*b*. The depicted cross-bar has an C-shaped cross section with a vertical web 62*a* and a top horizontal flange 62*b* at a top of the vertical web 62*a* and a bottom horizontal flange 62*c* at the bottom of the vertical web 62*a*. The opposing ends of the web 62*a* are bent at right angles to the plane of the web 62*a* to form a connecting bracket 64 which flange is and shaped to form hooks 66 having a recessed portion 68. The connecting bracket 64 preferably has the same height as the web 62*a*. The connecting brackets 64 are preferably bent in the same direction that the top and bottom flanges 62*b*, 62*c* extend so both the top and bottom flanges 62*b*, 62*c* and connecting brackets 64 are on the same side of the web 62*a*. The hooks 66 and recess 68 are configured so the shaft 42 of connector 40 fits into the recess 68 while the hooks 66 prevent the enlarged head 44 of the connector 40 from pulling out of the recess.

The hooks 66 are in the plane of the connecting bracket 64 and configured so each hook 66 can be placed above a different connector 40 and the bracket is then moved downward so the shafts 42 of a connector fit into the recess 68 of a hook. Two hooks 66 and recesses 68 are shown on each connecting bracket 64 in order to connect to and lock to two of the vertically aligned connectors 40 located along the length of the deck beams 26. The enlarged heads 40 are located inward of the While the connecting brackets 64 of cross-bars 60 are located to engage the connectors 32 the connecting brackets 64 are also configured so that they do not hit the top or bottom flanges 36, 32, respectively and can be fit inside the open portion of the channel forming the deck beam 26. The web 62*a* thus has a reduced height end section 70 extending from an end 72 of the top flange 62*b* to the bent connecting bracket 64. The reduced height end section 70 forms a notch or cut-out in one edge of the cross-bar 60. The top edge 74 of the reduced height end section 70 is offset from the top surface of top flange 62*b* a predetermined amount that is discussed later. The reduced height end section 70 also offsets the connecting bracket 64 so that it can fit beneath the flange 36 on which shelving rests during use.

Referring to 1-2 and FIG. 10, three cross-bars 60 are shown extending between opposing front and back deck beams 26*a*, 26*b*. The number of cross-bars 60 can vary, as long as there are corresponding connectors 40 in the deck beams 26 to mate with the connecting brackets 64 of the cross-bars 60.

Referring to FIGS. 1-7, and 10 to 11, a shelving material 76 is placed on the top of each shelf. The shelving material 76 is preferably a sheet of material and is shown as a rectangular sheet of crossed-rods formed of cylindrical metal rods. The shelving material 76 may be a solid sheet of material or may take other forms. The shelving material 76 has a thickness t and the edges of the shelving material 76 rest on the top flange or shoulder 36. If the offset distance d of the top flange 36 is the same as the thickness t of the shelving material then the top surface of the shelf is flush with the top edge of the deck beam 26. If the offset distance d of the top flange 36 is greater than thickness t of the shelving material then the top surface of the shelving material 76 is below the top edge of the deck beam 26 so that boxes of material on the shelving material 76 will hit the deck beam and slide out less easily. If the offset distance d of the top flange 36 is less than thickness t of the shelving material then the top surface of the shelving material 76 is above the top edge of the deck beam 26 so that boxes of material on the shelving material 76 may engage the edge of the sheet of material 76 as boxes are slid off of elevated shelves, so it is preferably in such instances to have at least the front edge of the shelving material rounded to avoid damage to boxes of items placed on the shelving material.

In order to support the shelving material the cross-beams are configured so that the upper surface of the top flange 62*b* is on the same level as the top flange or shoulder 36. The notch formed by reduced height web section 70 allows the cross-bar 60 to be positioned to engage connectors 40 while the top flange 62*a* can be placed adjacent to the inward edge of top flange 36. The fingers 66 and connectors 40 are located to allow this relative positioning of the parts. The connecting bracket 64 of can enter the open section of deck beam 26 and the lower end of fingers 66 placed above the shafts 42 of connectors 40 because of the cut-out formed by top edge 72 of reduced height web section 70. The fingers 66 and cross-bar 60 can then be moved downward to engage the recess 68 with the shaft 42 so the enlarged head 44 locks the fingers and cross-bar 60 to the deck beam 26. Because there are at least two connectors 40 and fingers 66, the cross-bar 60 will not rotate about a longitudinal axis of the cross bar or an axis parallel thereto since the two connectors 40 prevent such rotation. Thus, the offset h from the top flange 62*a* to the top edge 74 of the reduced height web section 70 allows the connecting brackets 64 to be vertically positioned over connectors 40 for easy engagement of the fingers 66 with the connectors 40. The offset h is preferably greater than the length of the finger 66 and more preferably about 0.1-0.3 inches greater to allow more easy installation.

As well as locating fingers 66 an top edge 74 of the reduced height web section 70 to allow engagement of the fingers 66 with the connectors 40, the length of that top edge and the location of the end 72 of the top flange are selected to place the end 72 adjacent to the inside edge of the top flange 36.

Figure 13:
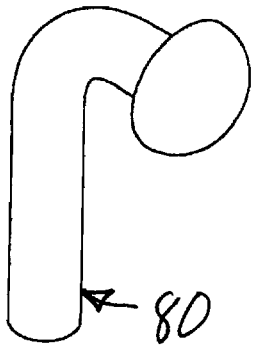
FIG. 13 is a perspective view of a fastener.
Figure 14:
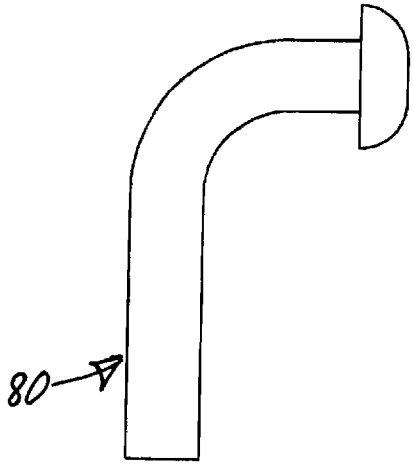
FIG. 14 is a side view of the fastener of FIG. 13.

In use, two end frame assemblies 20 are placed parallel to each other so the four posts 12 are arranged in a rectangle. A first deck cross-beam is then fastened to a different but corresponding (front or back) post 12 of each end frame assembly 20 by engaging connectors 52 with openings 22 in the posts, on the same side of the end frame assemblies 20. A second deck beam is placed parallel to the first deck beam 26 and in the same horizontal plane as the first deck beam 26 and connected to the posts 12 on the opposing side of the end frame assemblies as the first deck beam. Cross-bars 60 may then be inserted between those two parallel deck beams. The shelving material 76 may be installed at that time, or delayed until after further pairs of deck beams 26 and their cross-members 60 are installed. Alternatively, the cross-members 60 may be installed after a plurality or all of the desired number of deck beams 26 are connected to the posts 12. When the desired number of paired deck beams 26 are connected to the posts 12 on the first and second end frame assemblies 20 and the shelving material 76 rests on the desired number of cross-members, then the shelving rack 10 is completed. As desired, various fasteners 80 (FIGS. 2, 13-14) may be passed through mating holes 82 to help avoid inadvertent disconnection of the engaged parts. Thus, a fastener 80 with an enlarged head and a shaft may pass through aligned holes 80 when the mounting brackets 50 engage the posts 12 to further inhibit relative movement of the parts when the shaft passes through them. Removal of the fastener 80 allowes relative movement and disassembly, as desired.

Additional frame assemblies 20 may be provided with deck beams 26 connecting the additional end frame assembly to either of the first or second end frame assemblies in order to extend the storage racks 10 any desired length.

The interlocking of the fingers 66 with the connectors 40 provides a fast and easy connection to stiffen the storage rack 10, while allowing faster assembly and disassembly of the storage racks 10. The interlocking connection is believed to be much faster than bolted connections and allows the movement of smaller, lighter parts than with a welded assembly. The cross-bar 60 supports the weight placed on shelving material 76 and strengthens the deck beams 26 against bowing apart in the plane of the beams and cross-bars. The cross-bars 60 resist rotation of the deck beams 26 about an axis along the length of the deck beam because of the interconnection of adjacent cross-beams formed by the cross-bars 60. The ability to easily attach cross-bars 60 allows any desired number of stiffening and strengthening bars to be added between the deck beams 26, thus allowing different shelves to have different stiffness.

The cross-bar 60 connects the deck beams 26 in a unique manner as compared to the prior art. The cross-bars 60 extend between the deck beams 26 such that connecting brackets 64 at opposing ends of the cross-bars 60 fit inside the open channel of the cross-beams 26 to connect two opposing cross-beams 26 forming the base support for a horizontal shelf. The cross-bar 60 has a reduced section web that forms a notch to make it easier to manually lock the end fittings 64 to the connectors 40 on the deck beams (or to disengage them). The location of the top flange 62*a* of the cross-bar 60 adjacent the lip or flange 36 of the deck beam 26 provides an easy assembly as well as allowing fairly continuous support to the shelving material 76.

The above description is given by way of example, and not limitation. Given the above disclosure, one skilled in the art could devise variations that are within the scope and spirit of the invention disclosed herein, including various sectional shapes of the cross-bar 60. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A cross bar for a support frame for a shelf assembly, said shelf assembly including a pair of rear posts extending upward and an opposed pair of front posts extending upward with elongated front and rear deck beams extending between and connected to respective pairs of rear posts and front posts in the same plane and parallel to each other to define a support for a shelf, each of the deck beams having an open cross-section with a vertical beam web and opposing top and bottom flanges extending from the beam web toward an inside of the shelf assembly, the opposing top and bottom flanges being separated by a distance D, the top flange having a width W and being offset vertically by a distance O below a top edge of the vertical beam web, the beam web having at least one pair of vertically aligned connectors extending inward from the beam web, each connector having an enlarged connector head with a short connector shaft extending between the head and shaft, the cross-bar comprising:

an elongated member having a vertical cross-bar web with at least a top flange extending laterally to a first side of the cross-bar web and at right angles to the cross-bar web, the cross-bar web having a height H which is less than the distance D, the vertical cross-bar web having a reduced height web section with a height R at opposing ends of the elongated member, the reduced height web section having no top flange thereon, each reduced height web section being connected to a connecting bracket that extends laterally to the first side of the cross-bar and at right angles to the reduced height web section, each connecting bracket forming at least two hooks extending laterally in the plane of the connecting bracket with each hook defining a vertical recess and with at least one hook defining a lateral opening for each recess, the recess configured to receive the short connector shaft but not allow passage of the enlarged connector head, each hook sized to fit between the beam web and the enlarged head of the connector during use;

wherein height R of the reduced height web section is smaller than the distance D and height H and is sized to fit vertically between the opposing top and bottom flanges of the deck beam and allow the connector shafts to enter the lateral openings of the at least one hook and move downward so each connector shaft engages a different one of the recesses during use;

wherein the reduced height web section extends from the connecting bracket a distance sufficient so the top flange of the cross-bar is adjacent to the top flange of the deck-beam and the height H of the cross-bar is selected so the top flange of the cross-bar is flush with the top flange of the deck beam.

2. The cross-bar of claim 1, wherein the cross-bar web has opposing top and bottom flanges extending to the same side.

3. The cross-bar of claim 1, wherein the lateral opening to the recess is configured to allow passage of the connector shaft but not the enlarged connector head.

4. The cross-bar of claim 1, wherein each hook is configured to fit snugly between the connector head and the vertical deck beam web.

5. The cross-bar of claim 1, wherein the height R of the reduced height web section and the height of the cross-bar web H section differ by about twice the offset distance O.

6. The cross-bar of claim 1, wherein the reduced height web section has a length that is about twice the width W.

7. The cross-bar of claim 1, wherein the cross-bar has a bottom flange extending along a length of the cross-bar vertical web.

8. A deck beam and cross-bar arrangement for use with a support frame for a shelf assembly, said shelf assembly including a pair of rear posts extending upward and an opposed pair of front posts extending upward with elongated front and rear deck beams extending between and connected to respective pairs of rear posts and front posts in the same plane and parallel to each other to define a support for a shelf, each of the deck beams having an open cross-section with a vertical beam web and opposing top and bottom flanges extending from the beam web toward an inside of the shelf assembly during use, the opposing top and bottom flanges being separated by a distance D, the top flange having a width W and being offset vertically by a distance O below a top edge of the vertical beam web, comprising:

two vertically aligned connectors connected to each beam web and extending inward from the beam web into the open section of the beam web at corresponding locations along the length of each beam web so the connectors are directly opposite each other during use, each connector having an enlarged connector head with a short connector shaft extending between the head and shaft; and a cross-bar including:

an elongated member having a vertical cross-bar web with at least a top flange extending laterally to a first side of the cross-bar web and at right angles to the cross-bar web, the cross-bar web having a height H which is less than the distance D, the vertical cross-bar web having a reduced height web section with a height R at opposing ends of the elongated member, the reduced height web section having no top flange thereon, each reduced height web section being connected to a connecting bracket that extends laterally to the first side of the cross-bar and at right angles to the reduced height web section, each connecting bracket forming at least two hooks extending laterally in the plane of the connecting bracket with each hook defining a vertical recess with at least one hook also defining a lateral opening thereto, the recess configured to receive the short connector shaft but not allow passage of the enlarged connector head, each hook sized to fit between the beam web and the enlarged head of the connector during use;

wherein height R of the reduced height web section is smaller than the distance D and height H and is sized to fit vertically between the opposing top and bottom flanges of the deck beam and allow the connector shafts to enter the lateral openings of the at least one hook and move downward so each connector shaft engages a different one of the recesses during use;

wherein the reduced height web section extends from the connecting bracket a distance sufficient so the top flange of the cross-bar is adjacent to the top flange of the deck-beam and the height H of the cross-bar is selected so the top flange of the cross-bar is flush with the top flange of the deck beam.

9. The deck beam and cross-bar arrangement of claim 8, wherein the cross-bar has a bottom flange extending along a length of the cross-bar vertical web.

10. The deck beam and cross-bar arrangement of claim 8, wherein the lateral opening to the recess is configured to allow passage of the connector shaft but not the enlarged connector head.

11. The deck beam and cross-bar arrangement of claim 8, wherein each hook is configured to fit snugly between the connector head and the vertical deck beam web.

12. The deck beam and cross-bar arrangement of claim 8, wherein the height R of the reduced height web section and the height of the cross-bar web H section differ by about twice the offset distance O.

13. The deck beam and cross-bar arrangement of claim 8, wherein the reduced height web section has a length that is about twice the width W.

14. A kit for a shelving assembly having a pair of rear posts configured to extend upward during use and a pair of front posts configured to extend upward during use, at least one pair of elongated front and rear deck beams configured to extend between and connected to respective pairs of rear posts and front posts in the same plane and parallel to each other to define a support for a shelf during use, each of the deck beams having an open cross-section with a vertical beam web and opposing top and bottom flanges extending from the beam web toward an inside of the shelving assembly during use, the opposing top and bottom flanges being separated by a distance D, the top flange having a width W and being offset vertically by a distance O below a top edge of the vertical beam web, the kit further comprising:

at least one pair of vertically aligned connectors extending inward from each beam web at corresponding locations along the length of each beam web so the connectors are directly opposite each other during use, each connector having an enlarged connector head with a short connector shaft extending between the head and shaft;

a cross-bar comprising:

an elongated member having a vertical cross-bar web and at least a top flange extending laterally to a first side of the cross-bar web and at right angles to the cross-bar web, the cross-bar web having a height H which is less than the distance D, the vertical cross-bar web having a reduced height web section with a height R at opposing ends of the elongated member, the reduced height web section having no top flange thereon, each reduced height web section being connected to a connecting bracket that extends laterally to the first side of the cross-bar and at right angles to the reduced height web section, each connecting bracket forming at least two hooks extending laterally in the plane of the connecting bracket with each hook defining a vertical recess and a lateral opening to at least one of the recesses, the recess configured to receive the short connector shaft but not allow passage of the enlarged connector head, each hook sized to fit between the beam web and the enlarged head of the connector during use;

wherein height R of the reduced height web section is smaller than the distance D and height H and is sized to fit vertically between the opposing top and bottom flanges of the deck beam and allow the connector shafts to enter the lateral opening of the at least one hook and move downward so each connector shaft connects with a different one of the recesses during use;

wherein the reduced height web section extends from the connecting bracket a distance sufficient so the top flange of the cross-bar is adjacent to the top flange of the deck-beam and the height H of the cross-bar is selected so the top flange of the cross-bar is flush with the top flange of the deck beam; and at least one rectangular sheet of shelving material configured to fit between the deck beams and having a thickness of about O or slightly less.

15. The kit of claim 14, wherein the lateral opening to the recess is configured to allow passage of the connector shaft but not the enlarged connector head.

16. The kit of claim 14, wherein each hook is configured to fit snugly between the connector head and the vertical deck beam web.

17. The kit of claim 14, wherein the height R of the reduced height web section and the height of the cross-bar web H section differ by about twice the offset distance O.

18. The kit of claim 14, wherein the reduced height web section has a length that is about twice the width W.

19. The kit of claim 14, wherein the cross-bar has a bottom flange extending along a length of the cross-bar vertical web.

* * * * *